United States Patent [19]

Mele

[11] Patent Number: 4,770,020

[45] **Date of Patent: * Sep. 13, 1988**

[54] PART-SHAPING APPARATUS BY FLOW FORGING AND SHEET-METAL RUBBER FORMING

[76] Inventor: Joseph J. Mele, 188 Warner Rd., Huntington, N.Y. 11743

[ * ] Notice: The portion of the term of this patent subsequent to Sep. 2, 2003 has been disclaimed.

[21] Appl. No.: 899,559

[22] Filed: Aug. 25, 1986

Related U.S. Application Data

[63] Continuation-in-part of Ser. No. 647,900, Sep. 6, 1984, Pat. No. 4,608,848.

[51] Int. Cl.[4] ..... B21J 13/04

[52] U.S. Cl. ..... 72/184

[58] Field of Search ..... 72/184, 481; 403/113, 403/116, 117

[56] References Cited

U.S. PATENT DOCUMENTS

| | | | |
|---|---|---|---|
| 628,564 | 7/1899 | Traxler | 72/184 |
| 790,798 | 5/1905 | Lytle | 403/116 |
| 3,043,167 | 7/1962 | Robbins | 72/481 |
| 3,847,004 | 11/1974 | Bringewald | 72/184 |
| 4,257,251 | 3/1981 | Jury | 72/184 |
| 4,608,848 | 9/1986 | Mele | 72/184 |

*Primary Examiner*—Lowell A. Larson

*Attorney, Agent, or Firm*—Erwin S. Teltscher

[57] ABSTRACT

An apparatus for flow-forging and sheet-metal rubber-forming a shaped part from a work includes two members spaced from one another which define a pressure zone therebetween. First and second dies disposed between the members clamp the work therebetween, and a roller conveyor transports one die along a transport direction. The dies are driven to and from the pressure zone, and one die includes a plurality of adjoining pressure-transferring elements. In a plurality of self-adjustable matching devices, each is interposed between the roller conveyor and a pressure-transfer surface of a corresponding pressure-transferring element. Each matching device automatically adjusts its position, as it passes through the converging pressure zone. A longitudinal member of each matching device has a substantially plane surface of a width exceeding at least a center-to-center spacing of two adjoining rollers of the roller conveyor. Substantially each longitudinal member is constrained to pivot about an axis substantially parallel to the plane surface. The pressure-transferring elements, which move in the transport direction, also move from one member towards another, while being transported through the pressure zone. As a gradually and smoothly increasing pressure is applied to the work by the members during the transport of the dies through the pressure zone, any recess flow-forged in the shaped part is smooth and free of any ridges.

13 Claims, 10 Drawing Sheets

FIG. 13
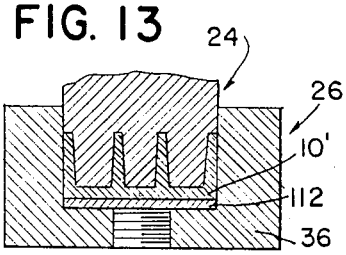
FIG. 14
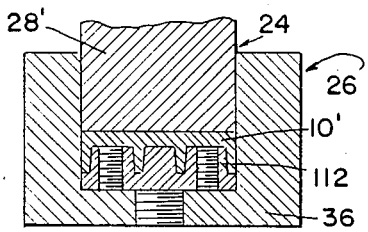
FIG. 15
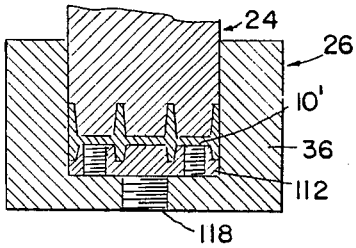
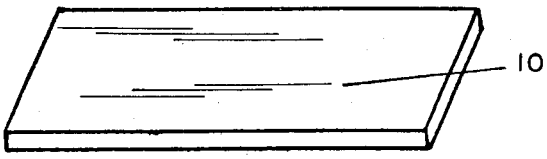
FIG. 16
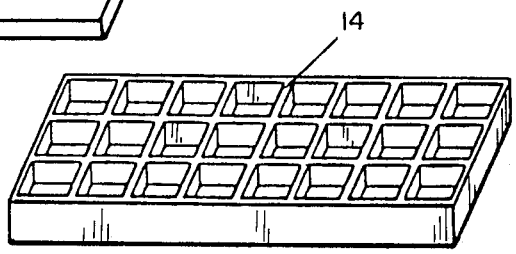
FIG. 17

PART-SHAPING APPARATUS BY FLOW FORGING AND SHEET-METAL RUBBER FORMING

CROSS-REFERENCE TO RELATED APPLICATIONS

This application is a continuation-in-part of application Ser. No. 647,900 filed on Sept. 6, 1984, now U.S. Pat. No. 4,608,848 granted Sept. 2, 1986.

BACKGROUND OF THE INVENTION

The invention relates to an apparatus for forming a shaped part from a work. It includes two members spaced away from one another at a settable distance and defining a pressure zone therebetween, holder means for maintaining the setting of the aforesaid distance, first and second die means clamping the work therebetween, roller means, including a plurality of rollers in operative contact with one of the members for transporting at least one of the die means along a transport direction, and along a direction opposite thereto, and wherein the members have an inclination to one another so as to cause the pressure zone to converge along the transport direction, and drive means for driving the die means along the roller means to the pressure zone and away therefrom. One of the die means includes a plurality of adjoining pressure elements, and each pressure-transferring element has a pressure-transfer surface on one end thereof facing the roller means, and a molding surface on the other end thereof determining at least partly the shape of the part. The pressure-transferring elements move in the transport direction, and also toward the other member while being transported through the pressure zone. The shaped part is obtained from the work by a gradually and smoothly increasing pressure being applied to the work by the members during the transport of the die means through the pressure zone.

A part-forming apparatus makes it possible to fabricate large forgings in a precise manner not feasible by conventional forging methods, and additionally at a considerable saving in the energy expended to produce such forgings.

From Bringewald, U.S. Pat. No. 3,847,004, there is known an apparatus for applying pressure, which includes a pressure base, pressure means vertically spaced above the pressure base to define a pressure zone, means for conveying work between the pressure base and the pressure means, and wherein one of the pressure base and the pressure means is inclined in the direction the work is conveyed. Rollers convert sliding friction into rolling friction as the work passes through the pressure zone, and means are provided for guiding the rollers as they pass under the pressure zone. An auxiliary pressure unit is adjustably mounted on the pressure means: additionally guide means are provided for the rollers as they pass under the pressure means, as well as adjusting means for adjusting the guide means to compensate for movement between the pressure means and the auxiliary pressure unit.

From Bringewald, U.S. Pat. No. 3,521,472, there has become known a process and an apparatus for the production of parts from ductile materials with integral stiffeners on one or both sides, and from Bringewald, U.S. Pat. No. 3,425,095 there has become known a process and an apparatus for producing metal plates with integral stiffeners.

Other patents or secondary references, which have some bearing on the present invention when taken in conjunction with Bringewald '004 are Melling, U.S. Pat. No. 3,303,833, which teaches self-adjusting cam shoes which are fitted with concave recesses, Groves et al, U.S. Pat. No. 3,233,444, which teaches a taper roll machine and method with piston and cylinder means, and fixing of blocks and cams in recesses, Fögelstrom, U.S. Pat. No. 3,263,573, which teaches a step-wise cylinder drive, Izett, U.S. Pat. No. 3,490,261, which teaches a heating station ahead of a forming station, and an unloading station following the forming station, and Worden, British Pat. No. 1,226,277, which teaches moulds for concrete bodies, including product removal means.

However, the Bringewald '004 patent, which postdates the Bringewald '472 and '095 references by approximately 4 and 6 years, respectively, is believed to be the closest reference to the present invention, particularly when taken in conjunction with the Melling, Groves et al, Fögelstrom, Izett, and Worden references.

The Bringewald '004 patent has, however several disadvantages, which are not overcome even by considering the Bringewald '004 patent in conjunction with one or several of the secondary references. A principal disadvantage vantage is the fact the rollers are linked together by the links, so as to form a chain, which in turn, has peaks and valleys on an outer surface thereof. As the work support is transported only by being disposed on a lower chain, slippage occurs between the work support and the lower chain, if the upper front edge of the frontmost force-translating element happens to lodge in one of the valleys, thus restraining any forward movement of the force-translating elements. This slippage cannot be eliminated if the work support is transported forwardly at a greater pull, or force. Furthermore, as pressure is initially exerted on the frontmost force-translating element downwardly, it will be moved downwardly, leaving a step between it and the next force-translating element. The resulting step can give rise to slippage again in a manner analogous to that caused by the front edge of the frontmost force-translating element. Such a slippage, in turn, causes firstly a non-uniform pressure being exerted on the work, and secondly a slow-down in the operation of the part-forming apparatus, and even jamming of the cooperating force-translating elements and the rollers. such a non-uniform pressure, in turn, causes the part to be formed with some deformities, at best resulting in non-uniform parts shaped by the apparatus according to Bringewald; thus a part made during one run does not necessarily resemble a part made during another run of the Bringewald apparatus.

SUMMARY OF THE INVENTION

It is accordingly an object of the present invention to obviate the disadvatages of the prior art, and in particular, to devise an apparatus which removes the cause of any slippage and deficiences in the parts formed.

This and other objects of the invention are attained by providing self-adjustable matching means interposed between the member defining an inclination with the transport direction and the other member, which defines, in turn, together with the inclination-defining member, a pressure zone. In this manner pressure transfer from the top member to the work is smoothed and maximized, resulting, in turn, in a more uniform and speedier production of shaped parts. Slippage is further eliminated by implementing the drive of the dies in the form of a hydraulically operated cylinder-piston mechanism, which replaces the slippage-prone chain of the prior art.

By using a substantially rectangular platform formed with two pairs of threaded openings disposed substantially in mirror symmetry about the minor and major axes, respectively, of the rectangular platform, and at least four threaded studs disposed in a respective number of openings, any bending forces acting on the threaded studs are eliminated, which constitutes an improvement of the two-column platform of the prior art.

By the pressure-transfer surface of each pressure-transferring element being concave, as viewed in the transport direction, and by the convex rod surface of each longitudinal rod of the matching means being in contact with the concave pressure-transfer surface of a corresponding pressure-transferring element, a large load-bearing surface is obtained, permitting, in turn, a longer life-span of the die. This contrasts favorably with the line contact of the prior art, which may be changed under large pressures to an indeterminate surface contact.

Other objects of the invention will in part become obvious, and will, in part become apparent from the claims following the specific description of the apparatus.

BRIEF DESCRIPTION OF THE DRAWING

The invention will be better understood with the aid of the drawing, illustrating embodiments of the invention, in which:

FIG. 13 is a section through the upper and lower dies with the work shaped into a part, and showing the material flow when using a segmented male plug, and an auxiliary, flat stripper plate on a side of the work opposite to that facing the male plug;

FIG. 14 is similar to FIG. 13, but shows a single male plug formed with a plurality of segments used on the bottom surface of the work, while the top part of the work faces a plurality of plugs, each having a flat operating surface;

FIG. 15 is also similar to FIG. 14, but uses a plurality of segmented male plugs on the top side of the work, but only a single segmented sculptured die plate on the bottom side of the work;

FIG. 16 is a perspective view of a blank workpiece;

FIG. 17 is a perspective view of a workpiece which has been formed, according to the present invention;

DESCRIPTION OF THE PREFERRED EMBODIMENTS

Figure 1:
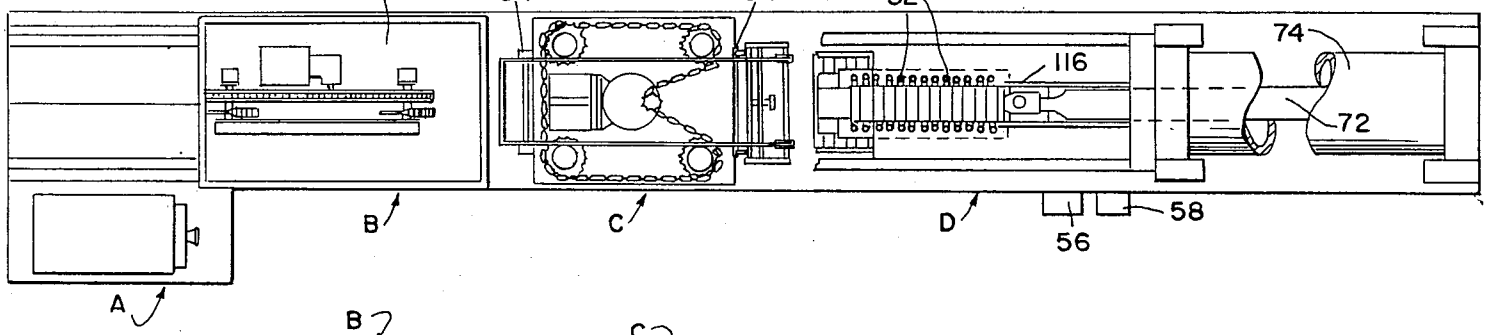
FIG. 1 is an overall plan view of the apparatus, according to the present invention.
Figure 2:
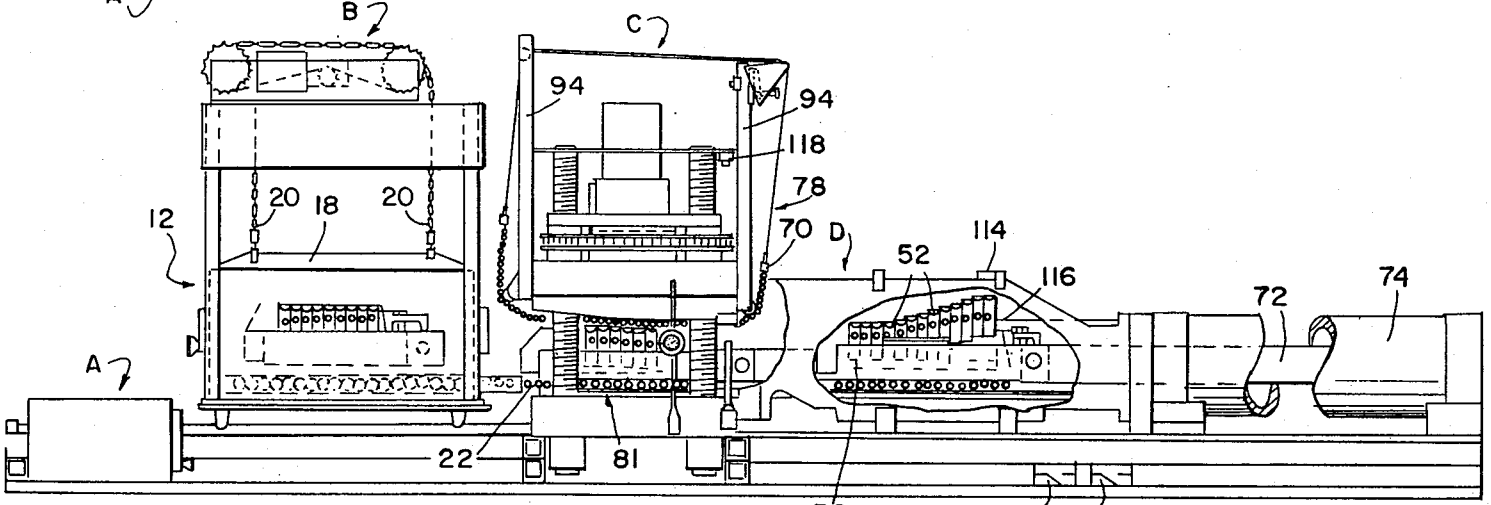
FIG. 2 is an overall elevation view of the apparatus shown in FIG. 1.
Figure 3:
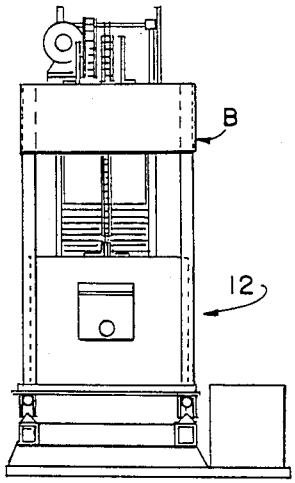
FIG. 3 is a side view of the apparatus shown in FIG. 1.

Referring now to the drawing, the overall arrangement of the part-forming apparatus by flow-forging is shown in FIGS. 1, 2 and 3, illustrating the overall plan view, overall elevation view, and side view of the inventive apparatus, respectively; an additional preheating station is denoted by A, while a work-loading an heating station B, a part-forming station C, and a die-release station D will best be seen in FIGS. 1, 2 and 3.

A work 10, for example in the form of a blank, best seen in FIG. 16, is normally first heated in the preheating station or material oven A to a predetermined temperature, which is about 700°-900° F. in the case of aluminum. It should be noted that it is also possible to dispense with the preheating station A, and to heat the work 10 only in the die oven 12. In the open position of the die oven 12, an oven chamber 18 will be seen to be lifted by a conventional chain-and-sprocket mechanism 20, not further described in detail.

At this stage the die assembly, implemented, for example, as clamping means for holding the work 10, will already have been placed in the die oven 12. The die assembly, or die means, will be seen to consist of upper die means 24, and lower die means 26, as shown, for example, in FIG. 4. The upper die means will be seen to consist of a plurality of plugs or pressure-transferring elements 28. Each pressure-transferring element 28 is formed on a normally upper and thereof with a generally concave pressure transfer surface 30, and a lower molding surface 32, which actually comes into contact with the part to be formed from the work 10. Facing an inclined roller chain 110 of a top member 78, there are disposed on each pressure-transferring element 28, alternately referred to as a male plug 28, self-adjusting matching means, for example, in the form of a longitudinal rod 34. Each longitudinal rod 34 has a substantially semi-spherical cross-section, so as to define a plane rod surface and a convex rod surface. Each rod 34 cooperates with a corresponding pressure-transferring element or male plug 28 so as to nestle therein facing a corresponding pressure-transfer surface 30, while facing the roller chain 110 of the top member 78 with the plane rod surface. In this manner, as will be seen later, each rod 34 is constrained to pivot about an axis substantially in the plane rod surface, so that the plane rod surface abuts the roller chain 110 of the top member 78 opposite the plane rod surface. The purpose of the self-adjustable matching means or rods 34 is to maximize pressure transfer from the top member 78 to the pressure surface 30, by each rod 34 automatically adjusting its position in response to the inclination of roller chain 110 of the top member 78, without jamming or jarring therewith, so that a gradually increasing pressure is applied to the work 10 from the top member 78 through the action of the inclined plane on the roller chain 110, the rods 34 and the pressure-transferring ring elements or male plugs 28, in order to obtain the shaped part. The mechanism by means of which the top member 78 applies pressure to the pressure surface will be discussed later.

Figure 4:
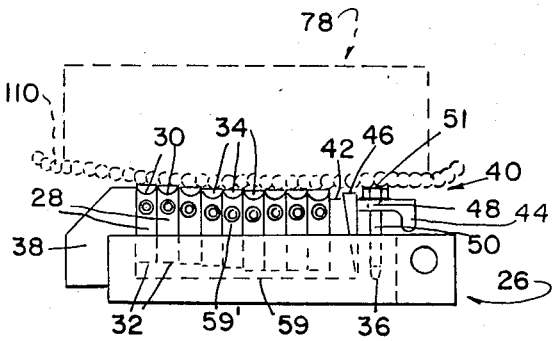
FIG. 4 is a fragmentary elevation view of the upper and lower die, showing a detail of the restraining means, and of the tightening means acting on the pressure-transferring elements.

The lower die means, or female portion of the die 26, as best seen in FIG. 4, consists substantially of a container 36, formed at the rear part or upstream portion thereof, as seen in the direction of transportation, with a wedge-shaped part 38, having an inner rear wall 39, and an inner front wall 41. One end plug of the plugs 28 normally abuts the rear wall 39, while the other end plug of the plugs 28 is normally spaced from the front wall 41. Plug holding or restraining means take the form, for example, of a wedge 42 cooperating with another wedge 46. The wedge 42 abuts the other end plug 28 with a first major surface thereof: the second major surface of the wedge 42 is transverse to the longitudinal direction of the container 36, and converges with the first major surface in a direction away from the bottom of the container 36. The wedge 46 abuts with one major surface thereof the other major surface of the wedge 42, while the other major surface of the wedge 42 converges with the one major surface portion of the wedge 46 in a direction transverse to the longitudinal direction of the container 36, and towards the bottom of the container 36. Tightening means 40 are mounted on the container 36 near the other end plug, and are constrained to move in the longitudinal direction of the container 36, so that upon actuation of the tightening means 40 in a predetermined sense, the plugs or pressure-transferring elements 28 are tightened to one another.

The tightening means 40 may consist, for example, of an L-shaped member 44, which has a normally horizontally projecting arm connected with a free end thereof to the other major surface of the wedge 46, and is formed with a threaded opening 48. A normally vertically positioned minor arm abuts with a free end portion thereof the rim of the container 38, and a bolt 50, which is threaded along a middle portion thereof, is normally engaged in the threaded opening 48. An upper end of the bolt 50 is formed with a head 51, and the other end of the bolt 50 is held in the container 38, so as to be freely rotatable therein. Consequently, when the bolt 50 is rotated in a predetermined sense, normally clockwise, the wedge 42 exerts a gradually increasing pressure on the other end male plug 28.

Figure 11:
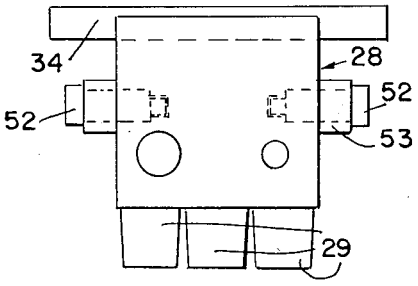
FIG. 11 is an elevation view of a typical male die segment.
Figure 12:
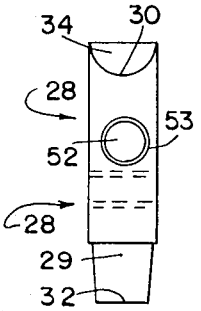
FIG. 12 is a side view of a typical male die segment.

Each male plug 28 is formed with lateral projections 52, preferably in the form of cylindrically formed projections, which are provided so as to enable die separation means, to be described hereinafter, and best seen in FIG. 11 and 12, to separate the upper die means 24, for example in the form of an asembly of males plugs 28, from the lower, or female die means 26. In order to reduce friction, each projection 52 is surrounded by a rotatable collar 53, which is arranged to make contact with the die separation means.

The pressure zone lies between a roller chain 110 of the top member or pressure unit 78, as seen in FIG. 2, and a base member 81 best seen in FIG. 2, on which there are disposed roller means, such as a roller conveyor 22.

Figure 5:
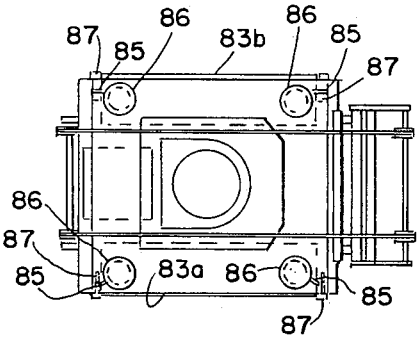
FIG. 5 is a top plan view of the upper platen assembly.
Figure 7:
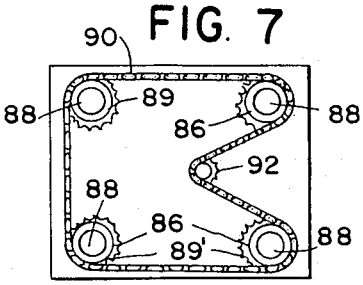
FIG. 7 is a section through the upper platen assembly.
Figure 6:
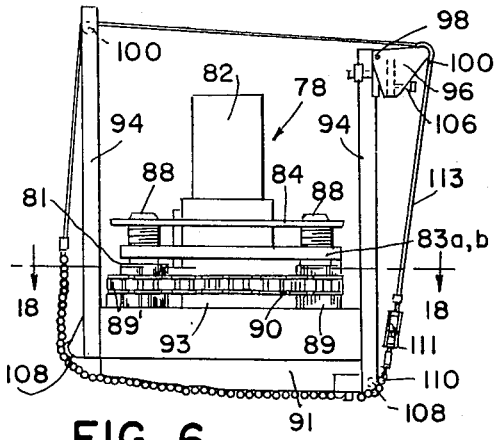
FIG. 6 is an elevation view of the upper platen assembly.
Figure 8:
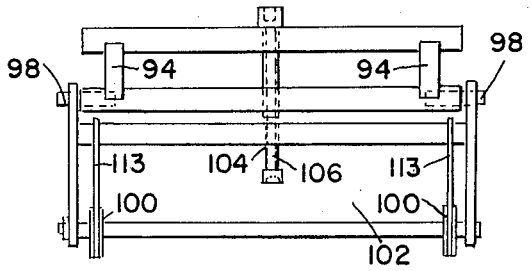
FIG. 8 is a fragmentary detail of the tensioning mechanism in plan view.
Figure 9:
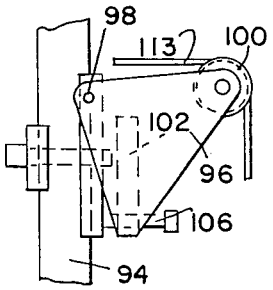
FIG. 9 is a fragmentary detail of the tensioning mechanism in side view.
Figure 10:
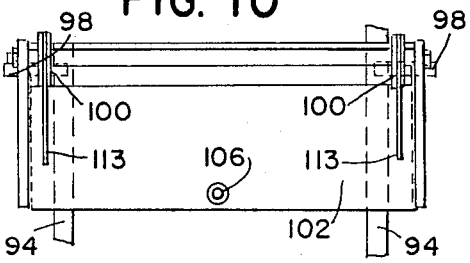
FIG. 10 is a fragmentary detail of the tensioning mechanism in elevation.

In a preferred form of the invention, and as best seen in FIGS. 5, 6 and 7, the top member or pressure unit 78 is provided with holder means or distance-adjusting means for selectably adjusting and maintaining the distance between the top member 78 and a base member 81, as best seen in FIG. 2. A platform 84 above plate 83 is formed with four openings 86, through which pass four threaded screws 88, respectively, on which there are threaded nuts 64 welded to sprocket wheels 89, respectively, and linking means, for example a chain 90, operatively links the four sprocket wheels 89. As seen in FIG. 5, the non-threaded openings 86 formed in the platform 84 communicate with respective slots 85. Corresponding screws 87, bridging respective slots 85, can be tightened so as to permit the platform 84 to be merely clamped to the screws 88. A drive sprocket 92, driven by the motor 82, is also linked up with the chain 90 as shown, for example, in FIG. 7, so that the plate 83, the motor 82 mounted on an upper platen 91, and the nuts 64 located between the platform 83 and the upper platen 91, can be made to move up and down, depending on the sense of rotation of the motor 82. A frame 94, seen for example, in FIGS. 6 and 7, is secured to the upper platen 91, which, in turn, is provided with tension adjusting means, such as a tensioning mechanism, shown in greater detail in FIGS. 8, 9, and 10.

Two brackets 96 project outwardly from the frame 94 near one corner thereof. The brackets 96 are pivoted to the frame 94 about an axle 98 and carry on it pulleys 100. To each bracket 96 there is secured a connecting plate 102, which in turn, is formed with a threaded opening 104. A threaded bolt 106, which is freely rotatable in the connecting plate 102, passes through a threaded opening 104. Consequently the pulleys 100 can be moved further outwardly from the frame 94, or moved further inwardly by rotating the threaded bolt 106 counterclockwise, or clockwise, respectively. Freely rotatable rollers or pulleys 108 are mounted near the other two corners of the frame 94. Roller means, such as a combination of an endless roller cable 113 and chain 110 pass around the pulleys 100 on top and the rollers 108 at the bottom, and its tension is adjustable by the aforesaid tensioning mechanism. The frontmost lower roller 108 is at a lower elevation, as seen in FIG. 6, than the rearmost lower roller 108, thus causing the roller means in the form of the roller chain 110, and consequently the pressure zone to converge along the transport direction of the work. The tension of the roller chain 110 and of the cable 113, in turn, is adjustable by a turnbuckle 111, best seen in FIG. 6, which links the roller chain 110 to a cable 113, the chain 110 and the cable 113 forming an endless loop.

The pressure zone will now be seen defined as extending between the roller conveyor 110, (which is located on an upper level, and is inclined to the transport direction), and the roller conveyor 22, being located on the lower level. As the die assembly, including the upper die means 24, and the lower die means 26, is forcibly pulled forwardly by the piston 72, it comes in contact with the inclined plane, implemented by the roller chain 110. The die assembly, and particularly the upper die means 24, extends along a substantially horizontal plane before entering the pressure zone. However, upon entering the pressure zone, the die assembly is forced to align itself with the inclined plane. This results in the familiar action and reaction phenomenon, namely the top member 78 causes each male plug 28 to be gradually and successively pressed onto the work 10 in the form of a blank plate. This in turn causes the material to flow, so as to eventually assume the desired configuration. This is illustrated in FIG. 13, where the work 10, originally shaped as a blank shown in FIG. 16, will be seen to be shaped into a part 14, best seen in FIG. 17, as the work 10 will have been molded between the upper male plugs 28 and a stripping plate 112 placed on an inner bottom of the container 36 of the lower die means, and wherein each male plug 28 has been provided with a flat operating surface. In FIGS. 14 and 15, however, there are illustrated alternate ways of shaping the part 10 seen to be a shaped part 15 in FIG. 14, and a shaped part 13 in FIG. 15, by making use of segmented male plugs 28. In the examples illustrated, each male plug 28 is provided, for example, with three prongs 29, which serve, for example, to form cavities in the work 10, which is to be formed into a part, into separate open-ended chambers. In FIG. 14 the segmented male plugs 28 are disposed below the work 10, while male plugs 28, which have each a flat operating surface, are placed above the work 10. In FIG. 15 segmented male plugs 28 are used on the top side of the work 10 and a one piece female die portion 115 is used on the bottom side. Each projection 52 extending from a male plug 28, FIG. 11, is surrounded by a roller 53, freely rotatable thereon. This feature reduces friction when the upper male plugs are separated from the female or lower die by the die separation means discussed earlier.

During the movement of the die assembly within the pressure zone, the rollers of the roller conveyors 22 and 110 rotate and thus greatly reduce any friction that would otherwise be created by a fixed inclined plane and the high pulling force developed by the driving force of the piston assembly, in the absence of any rollers.

Following completion of the molding process, the die means holding the now shaped part 14 are made to enter a die release station D, seen, for example, on the right-hand side of FIGS. 1 and 2. The die release station D is provided with die separating means in the form of longitudinal wedges 116 secured to rails 116', and interposed, on one hand, between the projections 52, extending on each side of a male plug 28, and on the other hand, the upper rim of the container 36 of the lower die means 26. The transport action of the piston 72 thus results in the male plugs 26 being lifted out of the lower die means, or female die 26, and providing free access to the shaped part 14. As the group of male plugs 28 emerge from the lower die means, or female die 26, the frontmost or lead male plug 26 comes in contact with a limit switch 114, as can best be seen in FIG. 1, which in turn actuates the drive motor 82 of the top member 78, so as to drive the member 78, which has mounted thereon the roller or chain 110, upwardly, thus moving the top member 78 away from the base member 80. The upward travel of the top member 78 is eventually stopped by another limit switch 118, shown in FIG. 1. The piston rod 72 is now moved in a rearward direction past the top member 78, to the end of its travel.

While the part is being formed, and also during the time period the formed part 14 is returned to the home position, the die oven 12 is made to travel away from the loading position and the parallel support or base member 80 is raised to support the lower conveyor roller 22, on which the female die 26 is travelling. Thus at the end of the leftward cylinder return stroke, the roller conveyor 22, which carries the female die 26, which, in turn, contains the shaped part 14, comes to rest on the parallel support plate, or base member 80. Thereafter the connecting pin 76 is withdrawn from the piston rod 74.

Figure 18:
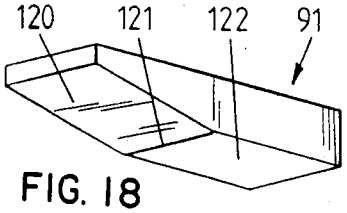
FIG. 18 is a perspective view of one version of the platen, formed with two separately defined surfaces, according to the present invention.
Figure 19:
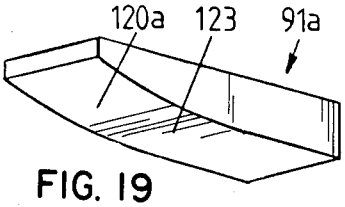
FIG. 19 is a perspective view of a second version of the platen, with the two separately defined surfaces shown in FIG. 18 merged into a single smooth surface, a wedge being formed at one end of the platen.
Figure 20:
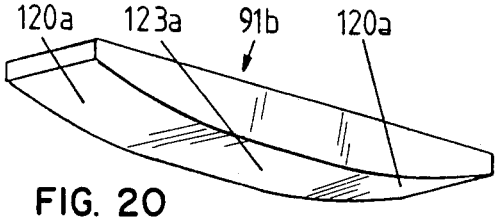
FIG. 20 is a perspective view of a third version of the platen, which is similar to that shown in FIG. 19, except that a wedge is formed at either end of the platen.

In an early version of the present invention the platen 91, as shown in FIG. 18, has been fabricated with a plane or lower surface 120 positioned so as to be normally inclined to the horizontal, and bordering a normally lower horizontal surface 122, the two surfaces adjoining an edge 121. In a later version of the invention it has been found more advantageous to fabricate the platen **91*a*, as shown in FIG. 19, with a smoothly arcuate lower surface 123, which has a thickness at a downstream end thereof, as seen along the travel direction of the work, which exceeds its thickness at the upstream end thereof. In yet an alternate version of the invention, the platen 91***b*, as shown in FIG. 20, is fabricated with a smoothly arcuate lower surface having a flat portion 123*a*; the flat portion 123*a* has a thickness which exceeds the thickness of each end 120*a*.

Figure 21:
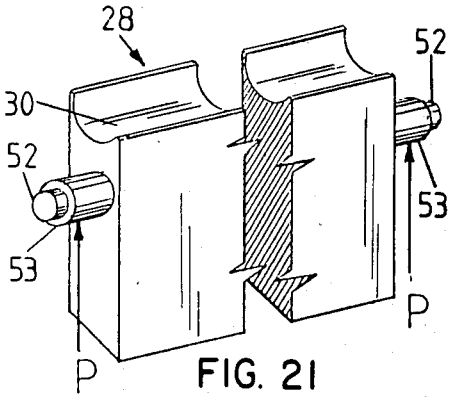
FIG. 21 is a perspective view of one version of the pressure-transferring element, according to the present invention, having a cantilevered construction.
Figure 22:
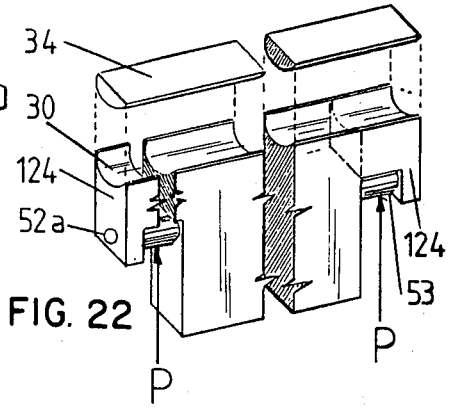
FIG. 22 is a perspective view of an alternate version of the pressure-transferring element, support means in the form of L-shaped overhangs being provided with apertures to receive respective ends of the lateral projections of the pressure-transferring element.

In an initial version of the invention, shown in FIG. 21, each pressure-transferring element 28 with its pressure-transfer surface 30 was fabricated with lateral projections 52, each lateral projection 52 being surrounded by a respective sleeve 53 freely rotatable therearound. It was realized that this cantilevered construction of the lateral projections 52 subjected these projections 52 to an undue stress. An improved construction, as shown in FIG. 22, provides for each pressure-transferring element 28 support means for example in the shape of a downwardly pointing L-shaped overhang 124, each provided with an aperture 52*a* for receiving the respective end of the lateral projection 52. In this manner the stresses as a result of the increased forces P on the lateral projections 53 are considerably reduced. the length of each pressure-transferring element can be changed to accomodate different respective sizes of the shaped part.

Figure 23:
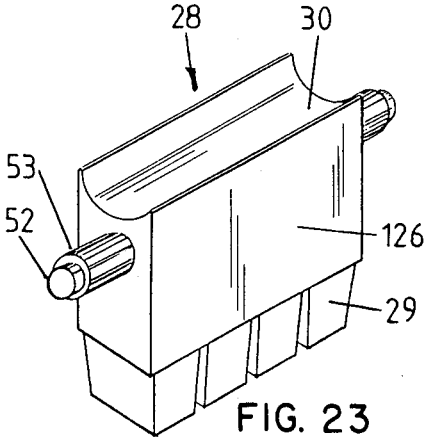
FIG. 23 is a perspective view of the pressure-transferring element, according to the present invention, formed with prongs integral therewith.
Figure 24:
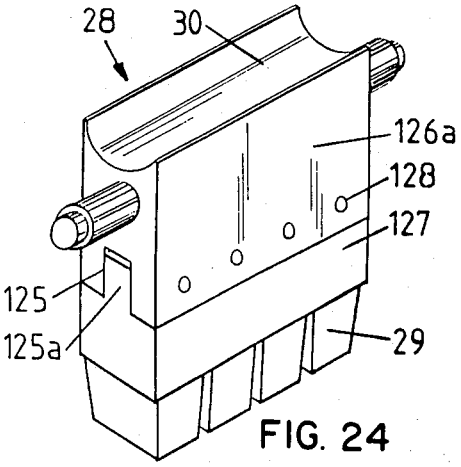
FIG. 24 is a perspective view of an alternate version of the pressure-transferring element, here formed with replaceable prongs.

In an initial version of the instant invention each pressure-transferring element 28, as shown in FIG. 23, was fabricated, for example, with prongs 29 corresponding to the form into which it was desired to shape the work 10. This necessitated using differnet respective pressure-transferring elements 28 for different respective shaped parts. A more economical embodiment is shown in FIG. 24, where an upper portion 126*a* of the pressure-transferring element 28 is formed with a slot 125 receiving a projection 125*a* formed on a lower portion 127 of the pressure-transferring element 28. The lower portion 127 is affixed to the upper portion 126*a* in a conventional manner, for example, by pins 128 passing through corresponding openings in the upper portion 126*a* and continuing to pass through other corresponding openings in the projection 125*a* of the lower part 127.

Figure 25:
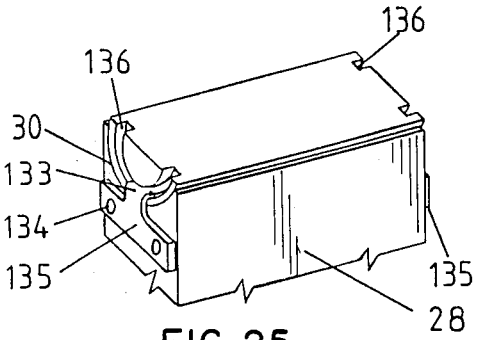
FIGS. 25–30 are various versions of securement means in perspective views, sectional views, and side elevation views for preventing each longitudinal rod of a corresponding pressure-element from sliding off laterally therefrom.
Figure 29:
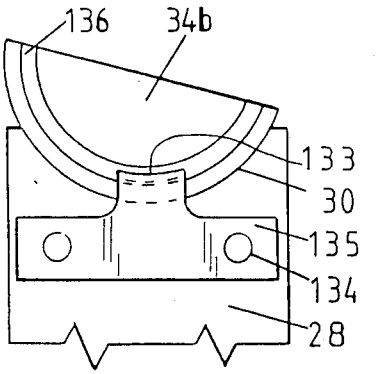
Figure 30:
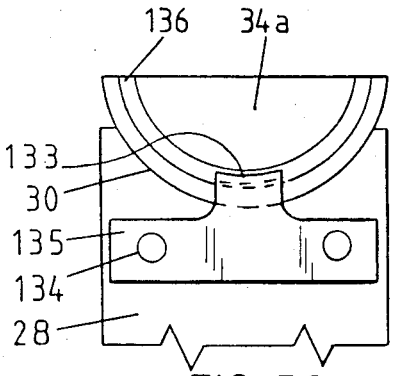

It has also been shown in practice to be advantageous is each longitudinal rod 34, which has a freedom to rotate within a limited angle within a corresponding pressure-transferring element 28, for example a longitudinal rod 34*a* shown in FIGS. 25, 29 and 30, is provided with securement means for preventing the longitudinal rod from sliding off laterally from the corresponding pressure-transferring element 28, while still retaining the freedom to rotate therein.

The securement means, in a first embodiment of the invention, may consist, for example, of an approximately semi-circular groove 136 formed on each side of the longitudinal rod 34*a*, with which respective top portions 133 of clips 135 are engaged. The clips 135 are secured to the pressure-transferring element 28, for example, by fastening devices 134. A perspective view of this embodiment is shown in FIG. 25, while FIG. 29 shows an end view of this embodiment with the rod 34*a* rotated away from a center position, and FIG. 30 shows an end view of this embodiment with the rod 34*a* actually located in a center position.

Figure 26:
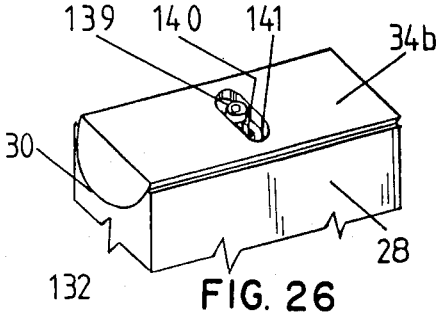
Figure 27:
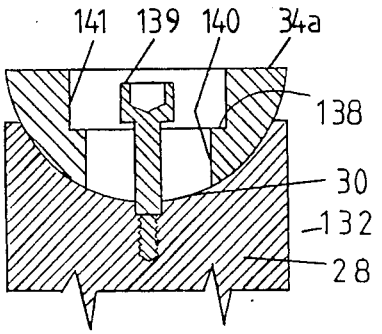
Figure 28:
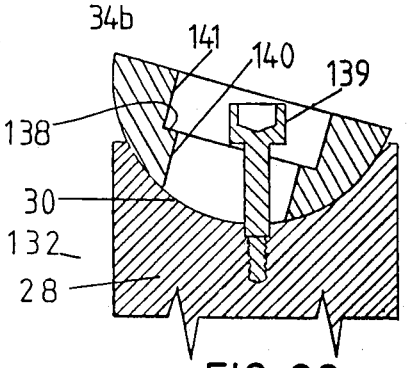

In a second embodiment of the invention, the securement means may include, for example, a slot or cutout 141 formed approximately in the center of the longitudinal rod 34*b*, which narrows into another cutout 140 so as to form a shoulder 138, as shown in FIGS. 26 through 28. A bolt 139 of a diameter slightly smaller than the width of the slot 140 is threaded into the pressure-transferring element 28, so that the longitudinal rod 34*b* is prevented from executing any lateral movement along the pressure-transferring element, while at the same time retaining its freedom of rotation through a limited angle. FIG. 28 shows a perspective view of this second embodiment, while FIG. 27 shows an end view of this embodiment, with the longitudinal rod 34*b* in a center position; FIG. 28 is similar to FIG. 26, but shows the longitudinal rod 34*b* rotated by a small angle away from the center position.

Figure 31:
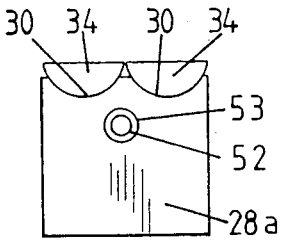
FIGS. 31–33 are side elevation views of various arrangements showing the cooperation of one or two longitudinal rods with a corresponding pressure-transferring element.
Figure 32:
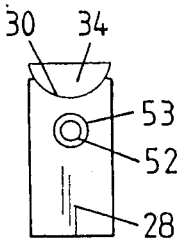
Figure 33:
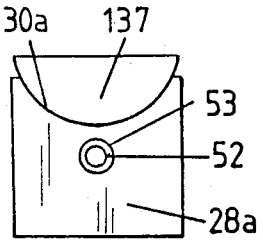

In FIG. 31 there is shown an end view of a variation of an arrangement showing the cooperation of two longitudinal rods 34, instead of a single longitudinal rod 34, with the pressure-transferring element 28. This arrangement will in particular find application where the width of the pressure-transferring element is relatively great. Other possible arrangements, differing slightly from the standard version, and again applicable where the width of the pressure-transferring elements 28 is relatively great, are shown in FIGS. 32 and 33.

Figure 34:
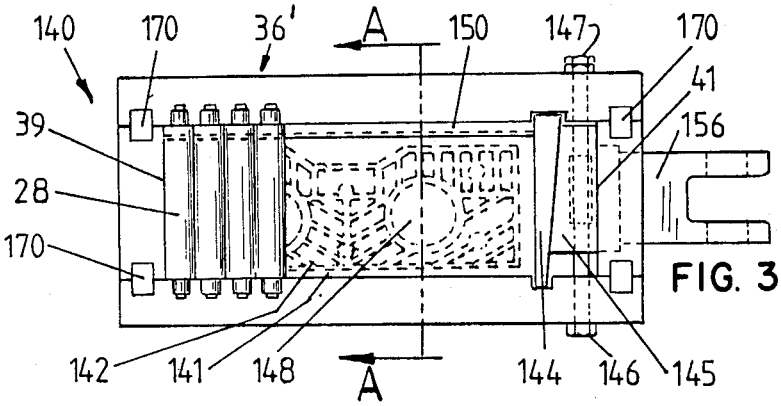
FIG. 34 is a top plan view of restraining means which tigthen the pressure-transferring elements in the die means to one another.
Figure 35:
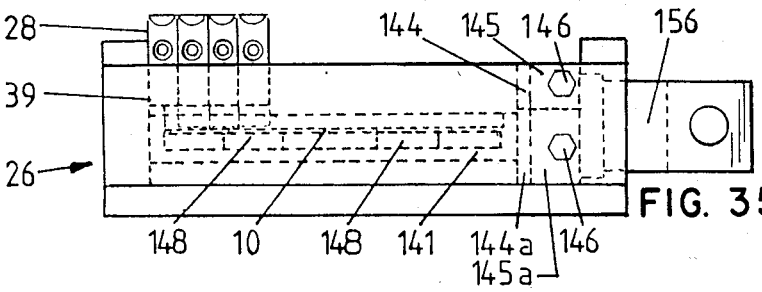
FIG. 35 is an elevation view of the restraining means corresponding to the top plan view shown in FIG. 34.

In FIGS. 34 and 35 there is shown an alternate embodiment of the restraining means, which tighten the pressure-transferring elements 28 to one another, FIG. 34 being a fragmentary top plan view, while FIG. 35 is an elevation view. The lower holder 26 contains the female portion of the die. The holder 26 is formed with a rear wall 39 and a front wall 41, which will be seen to receive the pressure-transferring elements 28. As seen in FIGS. 34 and 35, the left-most or most rearward pressure transferring element 28 abuts the rear-wall 39 of the container 36. The right-most or most forward pressure-transferring element 28 (but which is not shown in FIG. 34) normally abuts tightening means, for example in the form of a first wedge 144, which in turn abuts a second wedge 145. The wedge 145 abuts with its frontmost surface the front wall 41 of the container 36. The wedge 145 is formed with an internal thread, which matingly engages with a threaded bolt 146 in such a manner that rotation of the bolt 146 in one sense, for example counter-clockwise, causes the wedge 14 to move in a direction transverse to the transport direction so as to exert pressure onto the wedge 144, and consequently tighten the pressure-transferring elements 28 to one another. Rotation of the bolt 146 in a clockwise sense, for example, will again loosen the coherence of the pressure-transferring elements 28. Two nuts 147 or other locking means threaded onto the bolt 146 ensure that once set, the bolt 146 remains in its set position. Elements 170 are keys or locking members which will described in more detail later.

Figure 36:
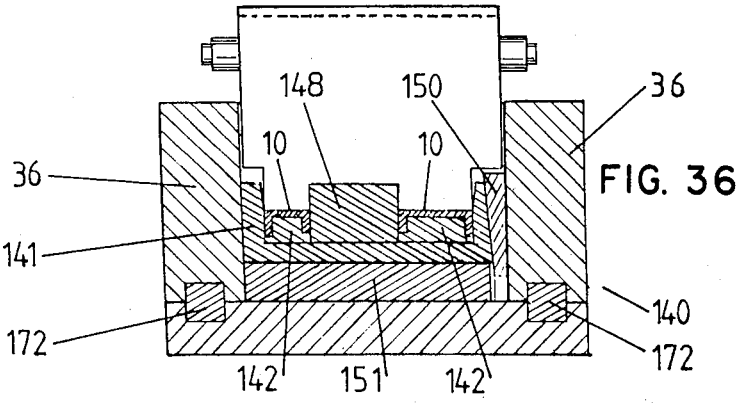
FIG. 36 is a section of the lower die means along line A—A of FIG. 34.

FIG. 36 is a section of the lower die means 26 along the lines A—A of FIG. 34. The work 10, which has already been shaped, is shown in dotted lines in FIG. 34. A wedge element 150 inserted into the container 36 serves to hold the female die 141 tightly in place within the holder 26. Other shaping elements 142 will be seen to be attached to element 141, bordering, in turn, an element 148 of a height exceeding that of elements 141, so that the shaped part 10 can be formed with a cutout. Keys 170 are lodged in the two-part container 36, and will be described in more detail in what follows.

Figure 37:
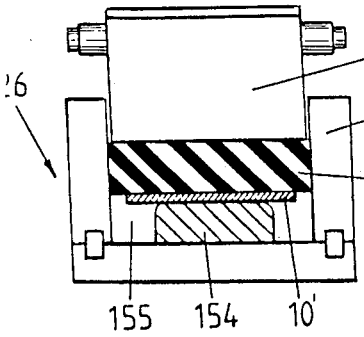
FIGS. 37–40 are side elevation views of an alternate embodiment, according to the present invention, using the process generally known as sheet-metal rubber forming, the work being shown in various stages as it is being formed into a part.
Figure 39:
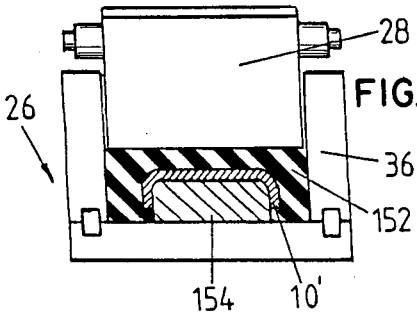
Figure 40:
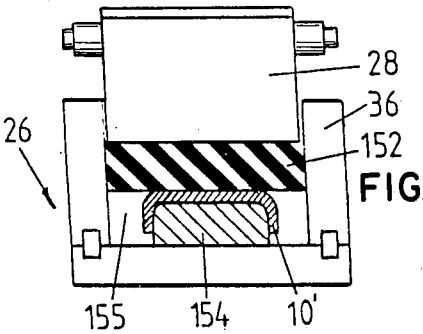

In FIGS. 37–40, which are cross-sections of the die means, there are shown a progression of steps permitting the shaping of the work 10' around a mold form 154 by means of a resiliently flexible material 152, such as hard rubber, which, after the shaping operation is completed, reverts to its original form. The work 10' is shown in its initial state, for example the shape of a flat plate in FIG. 37, before it is passed through the pressure zone. As the lower die means 26, in the form of the container 36, begin to pass into the pressure zone, the rubbery material 152 will be seen to wrap itself around the work 10', being squeezed gradually into a desired shape, as will be seen in the progression of steps illustrated in FIGS. 38 and 39. The original empty space shrinking into a smaller volume, as illustrated in FIG. 155 as seen in FIG. 37, wo;; be seen to be gradually 38, and disappear completely, as shown in FIG. 39, when a maximum pressure is exerted onto the pressure-transferring elements 28. After the die means emerge from the pressure-zone, the rubbery material, as shown in FIG. 40, resumes its initial shape. This process, generally known as sheet-metal rubber forming, permits a very flexible shaping of the work by using only a variably shaped mold form 154, with no need to shape the rubbery material 152.

Figure 41:
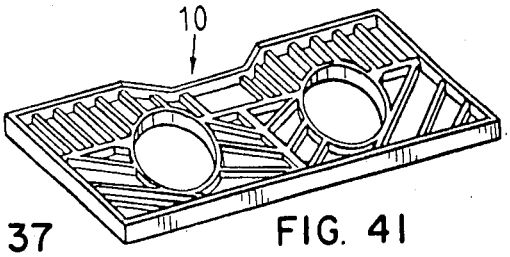
FIG. 41 is a perspective view of an example of a part which has been formed with cut-outs of a desired form, according to the present invention.
Figure 38:
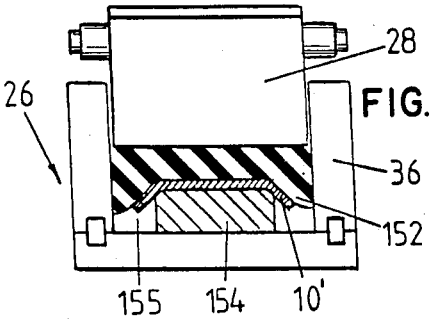

FIG. 41 shows a perspective view of an example of a forged work 10 shaped into a part of a desired form, including cutouts of an arbitrarily selected shape.

Figure 42:
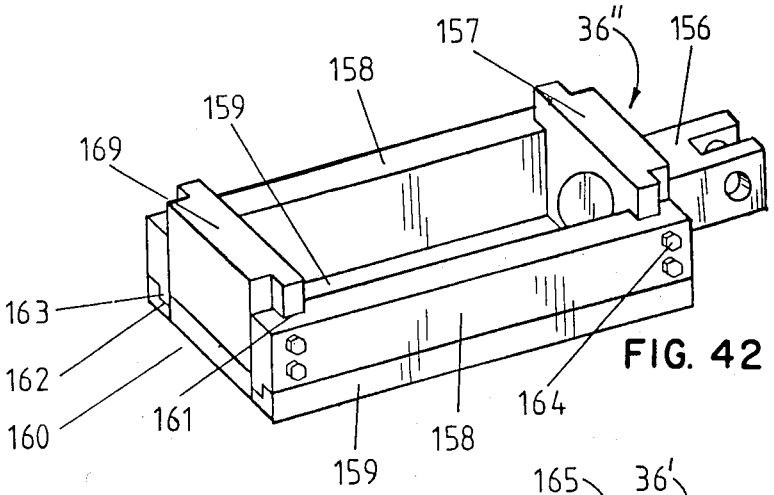
FIGS. 42 and 43 show perspective views of alternate build-up configurations of the container holding the pressure-transferring elements.
Figure 43:
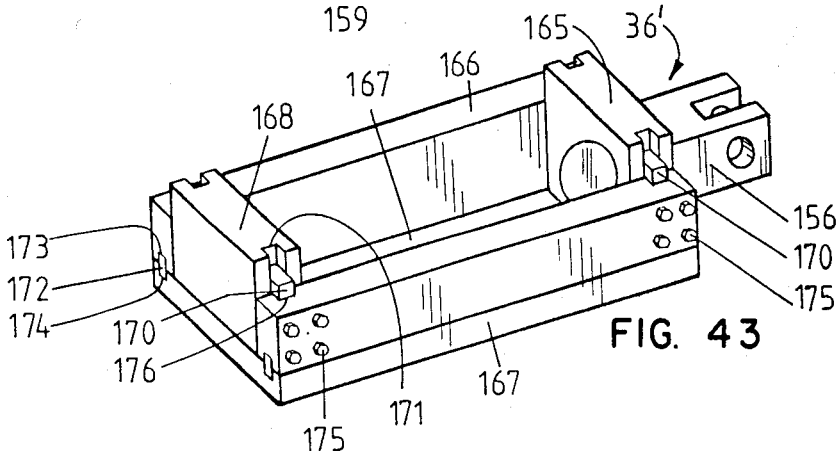

FIGS. 42 and 43 show perspective views of various build-up configurations of the container 36. Thus in FIG. 42 the container 36" is built up from a lower-most base element 159 formed with longitudinal slots 162 to slidably accept therein normally upstanding plates 158, formed, in turn, with downwardly extending projections 163 engaging the slots 162. A rear plate 169 closes off the rear end of the container 36, while a front plate 157 closes off the front end of the container 36. Each of the aforesaid plates is formed with lateral extensions 160 which fit into grooves 161 formed on the respective upstanding plates 158. A connecting member 156 serves to be connected to the (non-illustrated) piston 72.

The alternative configuration of a container or dieholder 36' seen in FIG. 43 shows a base plate element 167 formed with two longitudinal slots 174, and upstanding plates 166 on either longitudinal side of the base plate element 167 formed with respective longitudinal slots 173 aligned with the longitudinal slots 174 of the base plate element 167. Keys, or key elements 170 and 172 are used to assemble the container or dieholder 36' and resist pressure, so that the number of bolts can be minimized. A front plate element 165 closes off the front end of the container 36', while a rear plate element 168 closes off the rear end of the container 36'. Each of the aforesaid plate elements is formed with vertically extending slots 176, which slidably accept keys, or key elements 170.

Figure 44:
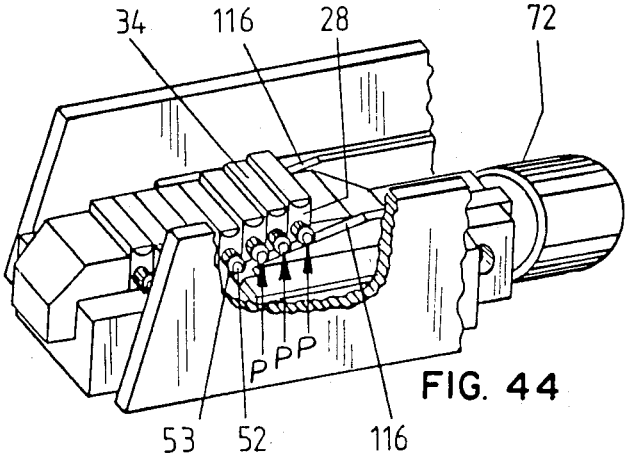
FIG. 44 is a perspective view showing the interaction of the die separating means in the form of longitudinal wedges with sleeves rotatably positioned around projections of a corresponding pressure- transferring element.

FIG. 44 shows more clearly the interaction of the die separating means in the form of the longitudinal wedges 116 with the sleeves 53 rotatable around the projections 52, which project from the pressure-transferring elements 28, as the piston 72 pulls the die means forwardly.

Figure 45:
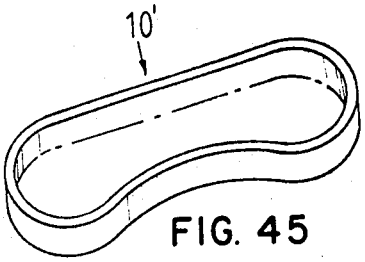
FIG. 45 shows in perspective view a part formed by the devices and the process illustrated in FIGS. 37–40.

A exemplary part shaped by the aforedescribed process is shown in FIG. 45.

Figure 46:
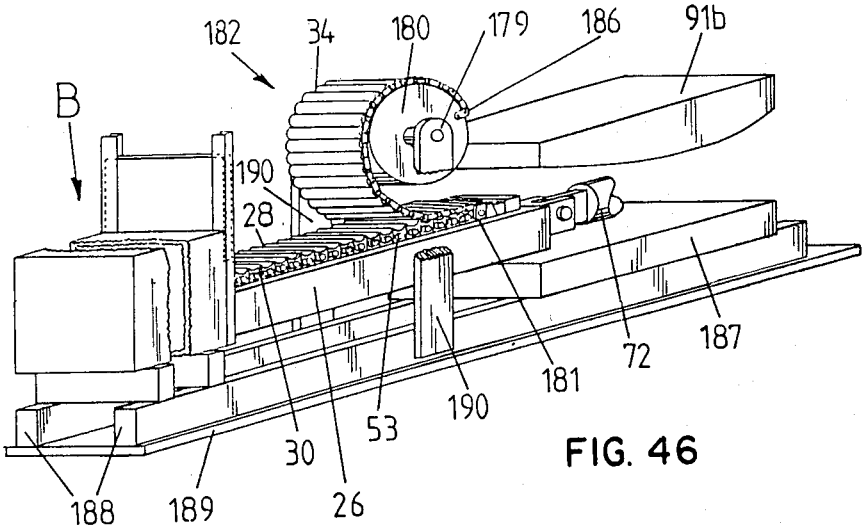
FIG. 46 is a perspective view of a variation of the present invention employed when flow-forging alloys require heating at elevated temperatures.
Figure 47:
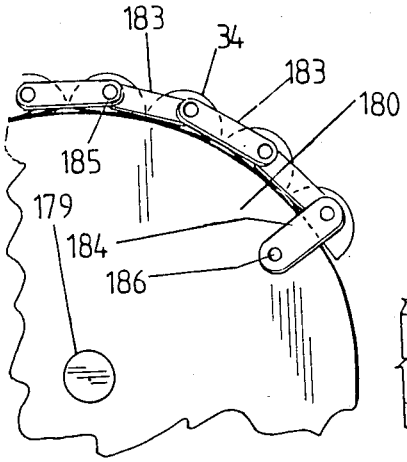
FIG. 47 is a large-scale detail of a part of the drum and chain shown in FIG. 46.
Figure 48:
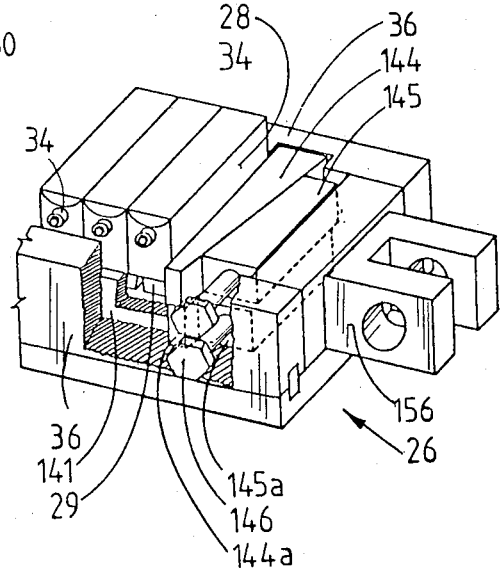
FIG. 48 is a perspective view of the version of the restraining device shown in FIGS. 34 and 35.

The construction shown in FIGS. 46 and 47 solves a problem when flow-forging alloys require heating at elevated temperatures, such as titanium. At very elevated temperatures the longitudinal rods 34, if made of conventional metals, begin to soften, and lose their temper. Rather than fabricating the elements 34 from more expensive and exotic heat-resisting materials, this problem can be circumvented by arranging the elements 34 in such a manner so that they do not have to be heated in the work-loading and heating station B.

This problem is solved by linking the longitudinal rods 34 to one another so as to form a chain, wrapping the resulting chain around a drum, and unrolling that chain so that the longitudinal rods 34 come in contact with the concave surfaces on the pressure-transferring elements 28 just before the die means are passed to the pressure zone, but downstream of the work-loading and heating station B.

This concept is implemented by the longitudinal rods 34 being pivotally linked by link means, such as links 183 along a direction transverse, and in particular, perpendicular to the transport direction. The resulting chain 182 is then wrapped around a drum or roller 180 having a shaft 179 journalled in a stationary frame. A clip 181 is fastened to the front-most link 183 so as to attach the chain 182 to a projection 52 or sleeve 53 of a frontwardly situated pressure-transferring element 28. Initially the chain 182 is fastened to the drum 180 by means of a link member 184 pinned to the drum 180 by means of a pin 186. As the last longitudinal rod 34 leaves the drum 180, the connecting link 184 is released from the drum 180 by depressing the pin 186. When the die assembly is returned to the work-loading and heating station B, the process is reversed by the chain 182 being rewound onto the drum 180.

I wish it to be understood that I do not desire to be limited to the exact details of construction shown and described, for obvious modifications will occur to a person skilled in the art.

Having thus described the invention, what I claim as new and desire to be secured by Letters Patent is as follows:

1. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, a work loading and heating station upstream of said pressure zone for receiving and heating the work up to a predetermined temperature, said work loading station being arranged to receive said die means, and a die release station downstream of said pressure zone for separating said die means from one another, wherein said die release station includes die-separating means for separating one of said die means from the other of said die means following shaping of said work into said part, wherein said die separating means includes a pair of rails located above a plane operatively defining an upper surface of said other die means, and wherein said die separating means includes a pair of longitudinal wedges secured to said rails, the thin end of each wedge facing said work loading station, wherein each pressure-transferring element is formed with lateral projections on opposite minor sides thereof, respectively, at a level so that upper longitudinal surfaces of said wedges lift said pressure-transferring elements away from said other die means upon making contact with said lateral projections.

2. The apparatus as claimed in claim 1, further comprising a sleeve surrounding each lateral projection, and being freely rotatable therearound.

3. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by means of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, wherein said holder mans includes distance-adjusting means for selectably adjusting the distance between said two members to a desired spacing, second roller means wrapped at least partly around one of said members and operatively exerting a pressure on said one of said die means, and having an adjustable inclination with respect to said transport direction, and wherein said distance-adjusting means includes a platen, plate means disposed above said platen, a plurality of threaded studs disposed on said platen, a plurality of nuts threaded onto said studs, respectively, and held between said platen and said plate means, linking means in operative engagement with said nuts, and driver means operatively connected to said linking means, and rotatable by a selectd number of rotations, said selected number of rotations corresponding to said desired spacing, whereby, upon rotating said driver means by said selected number of rotations, the distance between said two members is adjusted to said desired spacing, wherein said platen has a smoothly arcuate lower surface and a thickness at a downstream end thereof as seen along said travel direction which exceeds the thickness thereof at an upstream end thereof.

4. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, wherein said holder mans includes distance-adjusting means for selectably adjusting the distance between said two members to a desired spacing, second roller means wrapped at least partly around one of said members and operatively exerting a pressure on said one of said die means, and having an adjustable inclination with respect to said transport direction, and wherein said distance-adjusting means includes a platen, plate means disposed above said platen, a plurality of threaded studs disposed on said platen, a plurality of nuts threaded onto said studs, respectively, and held between said platen and said plate means, linking means in operative engagement with said nuts, and driver means operatively connected to said linking means, and rotatable by a selected number of rotations, said selected number of rotations corresponding to said desired spacing, whereby, upon rotating said driver means by said selected number of rotations, the distance between said two members is adjusted to said desired spacing, and wherein said platen has a smoothly arcuate lower surface and a thickness near a center thereof which exceeds the thickness at each end thereof.

5. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, wherein each pressure-transfer surface of each pressure-transferring element is concave, and wherein said longitudinal member of each self-adjustable matching means includes a longitudinal rod having a substantially semi-spherical cross-section so as to define said plane surface and a convex rod surface along said longitudinal direction, each rod cooperating with a corresponding of each of said pressure-transfer elements so as to nestle therein facing the pressure-transfer surface thereof with said convex rod surface, and wherein said longitudinal axis is substantially in said plane surface, wherein each pressure-transferring element includes an upper portion, and a lower portion, one of said portions being formed with a slot, the other portion being formed with a projection mating with said slot, and attachment means for attaching said portions to one another.

6. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, wherein each pressure-transfer surface of each pressure-transferring element is concave, and wherein said longitudinal member of each self-adjustable matching means includes a longitudinal rod having a substantially semi-spherical cross-section so as to define said plane surface and a convex rod surface along said longitudinal direction, each rod cooperating with a corresponding of each of said pressure-transfer elements so as to nestle therein facing the pressure-transfer surface thereof with said convex rod surface, and wherein said longitudinal axis is substantially in said plane surface, wherein each rod has a freedom to rotate within a limited angle within a corresponding of said pressure-transferring elements, and further comprising securement means for preventing each rod from sliding off laterally from the corresponding pressure-transferring element, while retaining said freedom of rotation.

7. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, wherein each pressure-transfer surface of each pressure-transforming elements is formed with a plurality of concave grooves, and wherein each self-adjusting matching means includes at least one additional longitudinal member, each longitudinal member being formed as a longitudinal rod having a substantially semi-spherical cross-section so as to define said plane surface, and a convex surface along said longitudinal direction, each longitudinal rod cooperating with a corresponding groove of a corresponding of each pressure-transfer elements so as to nestle therein facing said corresponding groove with said convex rod surface, and wherein said longitudinal axis is substantially in said plane surface.

8. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, wherein said drive means includes a hydraulically operated cylinder-piston mechanism, and wherein the piston thereof has a predetermined stroke length, and is reciprocally movable into, and out of the cylinder, respectively, holding means mounted on the other die means for holding said pressure-transferring elements together under pressure, wherein the other die means include a longitudinal container having a bottom, a rear wall as defined in said transport direction, and a front wall, and wherein said pressure-transferring elements are received in said container, one end pressure-transferring element of said pressure-transferring elements normally abutting one of said walls, the other end pressure-transferring element being normally spaced from the other of said walls, two-part restraining means abutting the other end pressure-transferring element, and rotatable threaded tightening means mounted on said container and passing through one part of said restraining means so that rotation of said tightening means in a predetermined sense tightens said pressure-transferring elements to one another.

9. The apparatus as claimed in 8, wherein each pressure-transferring element includes support means for supporting outer ends of respective of said lateral projections.

10. The apparatus as claimed in claim 8, further comprising a plurality of elements insertable into said container and being adapted for shaping a lower surface of said work.

11. The apparatus as claimed in claim 8, wherein said container includes a plurality of container elements slidably fitting into one another.

12. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passes through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, wherein the other die means includes a mold form, and further comprising resiliently flexible material having an initial shape, and being interposed between said pressure-transferring elements and said mold form, so that any work placed between said resiliently flexible material and said mold form is at least partially wrapped around said mold form as said die means pass through said pressure zone, and as said resiliently flexible material surrounds the work wrapped around said mold form, said resiliently flexible material resuming its initial shape upon said die means emerging from said pressure zone.

13. An apparatus for flow-forging a shaped part from a work, comprising in combination two members spaced away from one another at a settable distance, and defining a pressure zone therebetween, holder means for maintaining the setting of said distance, first and second die means clamping said work therebetween, first roller means in operative contact with one of said members for transporting at least one of said die means along a transport direction, and along a direction opposite thereto, said first roller means including a plurality of rollers, two adjoining rollers defining a center-to-center spacing, said members having an inclination to one another so as to cause said pressure zone to converge along said transport direction, drive means for driving said die means along said roller means to said pressure zone, and away therefrom, one of said die means including a plurality of adjoining pressure-transferring elements, each pressure-transferring element having a pressure-transfer surface on one end thereof facing said roller means, and a molding surface on the other end thereof determining at least partly the shape of said part, and a plurality of self-adjustable matching means, each being free from jarring with said roller means and being interposed between said roller means and the pressure-transfer surface of a corresponding of said pressure-transferring elements during the transport thereof in said pressure zone along said transport direction for smoothing and maximizing pressure transfer from said one of said members to said pressure transfer surface through said rolling means by each of said matching means automatically adjusting the position thereof as it passing through said converging pressure zone, wherein each self-adjustable matching means includes at least one longitudinal member having a substantially plane surface of a width exceeding at least the center-to-center spacing of two adjoining rollers of said first roller means, substantially each longitudinal member being constrained to pivot about a longitudinal axis substantially parallel to said plane surface with respect to a corresponding of said pressure-transferring elements, so that its plane surface is in operative contact with at least two adjoining rollers, and free from jarring herewith, said pressure-transferring elements, in addition to moving in said transport direction, also moving towards said other of said members while being transported through said pressure zone, whereby a gradually and smoothly increasing pressure is applied to said work by said members during the transport of said die means through said pressure zone, so that any recess flow-forged in said shaped part is substantially smooth and free of any ridges, a work loading and heating station upstream of said pressure zone for receiving and heating the work up to a predetermined temperature, said work loading station being arranged to receive said die means, a die release station downstream of said pressure zone for separating said die means from one another, and link means for pivotally linking said longitudinal members to one another along a direction transverse to the longitudinal direction, so as to constitute a chain of the longitudinal members, and a roller arranged to have the longitudinal member chain wound therearound initially, said longitudinal member chain being capable of being rolled off from said roller so that said longitudinal members come into contact with respective of said pressure-transferring elements as said die means and said work are driven towards said pressure zone, whereby only said pressure-transferring elements, but not said longitudinal members are passed through said workingloading and heating station.

* * * * *